US006189778B1

(12) United States Patent
Kanter

(10) Patent No.: US 6,189,778 B1
(45) Date of Patent: Feb. 20, 2001

(54) CONTAINER WITH FRONT PULL-OUT PANEL

(76) Inventor: Allen Kanter, 1042 Gypsy Hill Rd., Penllyn, PA (US) 19422

( * ) Notice: Under 35 U.S.C. 154(b), the term of this patent shall be extended for 0 days.

(21) Appl. No.: 09/314,433

(22) Filed: May 18, 1999

Related U.S. Application Data

(60) Provisional application No. 60/085,802, filed on May 18, 1998.

(51) Int. Cl.[7] ..... A01K 1/00; B65D 25/04

(52) U.S. Cl. ..... 229/122.1; 229/122.11; 229/221; 229/172; 229/169; 229/170; 229/138; 221/305

(58) Field of Search ..... 229/122.1, 120.15, 229/120.18, 122, 216, 221, 120.11, 172, 169, 170, 138; 221/305

(56) References Cited

U.S. PATENT DOCUMENTS

| | | | | |
|---|---|---|---|---|
| 1,256,437 | | 2/1918 | Careaga . | |
| 2,465,324 | * | 3/1949 | De Mian | 229/165 X |
| 2,556,707 | * | 6/1951 | Rendall et al. | 229/122.1 |
| 2,803,390 | * | 8/1957 | MacKay | 229/122.1 |
| 2,907,512 | * | 10/1959 | Leone | 229/122.1 |
| 3,370,775 | | 2/1968 | Link . | |
| 3,478,948 | | 11/1969 | Dornbush . | |
| 3,568,911 | | 3/1971 | Bebout . | |
| 3,593,908 | | 7/1971 | Desmond . | |
| 3,944,128 | | 3/1976 | Hogan . | |
| 4,066,205 | * | 1/1978 | Griffith | 229/122.1 |
| 4,216,861 | * | 8/1980 | Oliff | 229/223 X |
| 4,293,091 | | 10/1981 | Gerard . | |
| 4,413,769 | | 11/1983 | Michetti . | |
| 4,550,853 | | 11/1985 | Grati . | |
| 4,602,735 | | 7/1986 | Aaron . | |
| 4,752,029 | * | 6/1988 | Buford | 229/122.1 |
| 5,238,181 | * | 8/1993 | Mahler | 229/215 |
| 5,259,631 | | 11/1993 | Brande . | |
| 5,458,272 | * | 10/1995 | Ward-Weber | 229/122.1 |
| 5,626,283 | * | 5/1997 | Mellon | 229/120.13 |
| 5,746,369 | | 5/1998 | McDermott . | |

* cited by examiner

*Primary Examiner*—Allan N. Shoap
*Assistant Examiner*—Tri M. Mai
(74) *Attorney, Agent, or Firm*—Synnestvedt & Lechner LLP

(57) ABSTRACT

A robust, stackable container for shipping goods and for displaying and dispensing the goods at the point of purchase is disclosed. The container has a pull-out panel comprising a portion of a side wall panel which is manually openable to display and dispense the goods. The pull-out panel is defined by a separation line in the wall panel formed by a plurality of perforations and is hingedly attached to the container. Wing flaps located on each end of the pull-out panel extend between the pull-out panel and the container providing side partitions preventing the goods from spilling out of the container when opened. The container wall panels are reinforced with reverse folded reinforcing flaps which strengthen the container to prevent crushing and bursting when stacked. The container is formed from die cut blanks into a knockdown state which can be assembled into the container and filled by automated processes.

14 Claims, 16 Drawing Sheets

20
46
46a
125
102
112a
32t
32a
112b
90
32d
26
48
48a
34
34b
26
98
104
96t
30
30t
44
44a
88
26
4
102
34t
50
50a
88
4
28t
68
28
36
58
66
56
54
96
100
92
94
30b
82
86
62
54
58
52
28
28b
64
86
84
60

20a
116
44a
122
28
36
38
118
40
42
114
50a
34
124
48a
120

20
48
48a
125
34
34t
26
90
32t
146
140
96
96t
32d
32a
144
50
50a
88
28t
11
100
68
66
56
54
78
98
28b
70
86
60
76
58
84
92
94
52
36
64
28
62
82
86
44
44a
30t
30
30b
46
46a
140

20a
124
46a
38
30
146
50a
114
144
28
36
40
118
42
120
122
44a

CONTAINER WITH FRONT PULL-OUT PANEL

CROSS-REFERENCE TO RELATED APPLICATIONS

This application claims the benefit of U.S. Provisional Application No. 60/085,802, filed May 18, 1998.

FIELD OF THE INVENTION

The present invention relates to stackable containers useful for shipping bulk goods and for displaying and dispensing the goods at the point of purchase, and more particularly, to such containers made from a corrugated paperboard blank and formable into the container automatically from a knockdown state.

BACKGROUND OF THE INVENTION

Containers find broad use in the shipment of many types of goods, especially bulk goods. Examples of bulk goods include many food items such as candy and snack foods, small hardware items, small toys and other consumer products. Increasingly, such containers have been found useful for the display and dispensing of the goods at the point of purchase in addition to their traditional function as a shipping container.

Conventional corrugated paperboard containers do not readily fulfill all of the requirements currently imposed upon them for the efficient shipment and display of bulk goods. An improved container would desirably include the following characteristics: (1) inexpensive to manufacture; (2) easily shipped to the user; (3) readily assembled and filled using automated equipment; (4) resistant to crushing or bursting when stacked; and (5) easily converted from a shipping container to a container for display and dispensing of the goods.

To insure that an improved container would be inexpensive to manufacture, it is advantageous to fabricate the container from a minimum of separate pieces. Preferably, the container should be formable by machine from a die cut blank or blanks with a minimum of hand labor operations necessary. Ease of shipment to a user can be achieved if the container is formable from the blank into a knockdown state which lies folded in a substantially flat configuration so as to occupy a minimum of space during shipment. The knockdown state also allows the container to be readily assembled and filled using automated equipment, as the knockdown is designed to be unfolded from its flat configuration into a container and then filled entirely by machine. Resistence to crushing or bursting when stacked is achieved by reinforcing the container wall panels with adjacently positioned reinforcing panels which help share the load of the contents and the weight of containers stacked above. Lastly, ease of conversion from a shipping container to a container for display and dispensing of the goods can be readily afforded by the use of a pull-out panel comprising one of the wall panels. The pull-out panel should allow the wall panel to be opened to reveal and dispense the contents of the container. It should have the strength to resist bursting open during container shipment or when stacked, and yet be easily manually opened without the need of tools or cutting when desired.

It is an object of the invention to provide an inexpensive container which can serve to ship bulk goods and to display and dispense the goods at a point of purchase.

It is another object of the invention to provide a container having a pull-out panel in one of its side walls which can be opened to display and dispense the goods in the container and which does not require special set up at the retail site.

It is yet another object of the invention to provide a container which can be fabricated from a minimum of pieces formed from die cut blanks.

It is another object of the invention to provide a container which can be formed into a knockdown state from die cut blanks.

It is still another object of the invention to provide a container which has a knockdown state which can be readily unfolded and filled with goods by automated machinery.

It is another object of the invention to provide a container which will resist bursting and crushing when stacked or shipped.

These and other objects will become apparent from a consideration of the drawings and detailed description of preferred embodiments.

SUMMARY OF THE INVENTION

The invention provides a container assembly comprising multiple wall panels attached to one another. Preferably, the container is made of corrugated paperboard, although other materials are also usable. The wall panels include a first, a second, a third and a fourth wall panel. Each of the wall panels have oppositely disposed top and bottom edges. A bottom flap is integrally and pivotally attached to the bottom edge of the first wall panel.

A pull-out panel, defined by a separation line, comprises a portion of the first wall panel. Preferably, the separation line comprises a series of perforations defining a top edge and two side ends of the pull-out panel. The pull-out panel has a bottom edge hingeably and integrally attached to the container, the pull-out panel being manually movable from a closed position to an open position. The bottom edge of the pull-out panel preferably is defined by at least a portion of the bottom edge of the first wall panel. A top portion of the first wall panel defines a remainder of the first wall panel, the top portion being arranged above, and not being part of, the pull-out panel.

A sub panel is positioned overlying and secured to an inside face of the pull-out panel. A pair of wing flaps, integrally attached to the sub panel and spaced apart from one another, extend inwardly of the container to prevent goods held within the container from spilling out when the pull-out panel is opened. At least one of the wing flaps includes a hook section positioned to engage the top portion to prevent further rotation of the pull-out panel when in the open position.

The container has a knockdown state where first and second knockdown walls attached to one another at first and second corners form a substantially flat assembly. The first knockdown wall includes the first and fourth wall panels in a substantially same first plane. The second knockdown wall comprises the second and third wall panels in a second substantially same plane parallel to the first plane.

The container assembly may include a divider panel extending between the first wall panel and one of the wall panels opposite the first wall panel. When a divider panel is present, the pull-out panel preferably includes a third wing flap secured to it between the pair of wing flaps at either end of the pull-out panel. The third wing flap extends inwardly of the container adjacent to the divider panel and provides a partition which keeps the goods on either side of the divider panel separated when the pull-out panel is in the open position. Preferably the divider panel has a reinforcing panel arranged in a face-to-face relationship. The third wing flap may comprise a portion of the divider panel defined by a series of perforations permitting the third wing flap to move away from the divider panel when the pull-out panel is moved to the open position.

The second, third and fourth wall panels are preferably strengthened with reinforcing panels integrally connected to the top edges of the panels and reverse folded over one or more fold lines into a face-to-face relationship with the wall panels. The reinforcing panels provide greater resistance to crushing and bursting of the container when stacked.

BRIEF DESCRIPTION OF THE DRAWINGS

The foregoing summary and the following detailed description may be better understood when read in conjunction with the accompanying drawings. For the purpose of illustrating the invention, preferred embodiments are shown in the drawings. It is understood, however, that this invention is not limited to the precise arrangements shown.

DETAILED DESCRIPTION OF THE PREFERRED EMBODIMENTS

Figure 1:
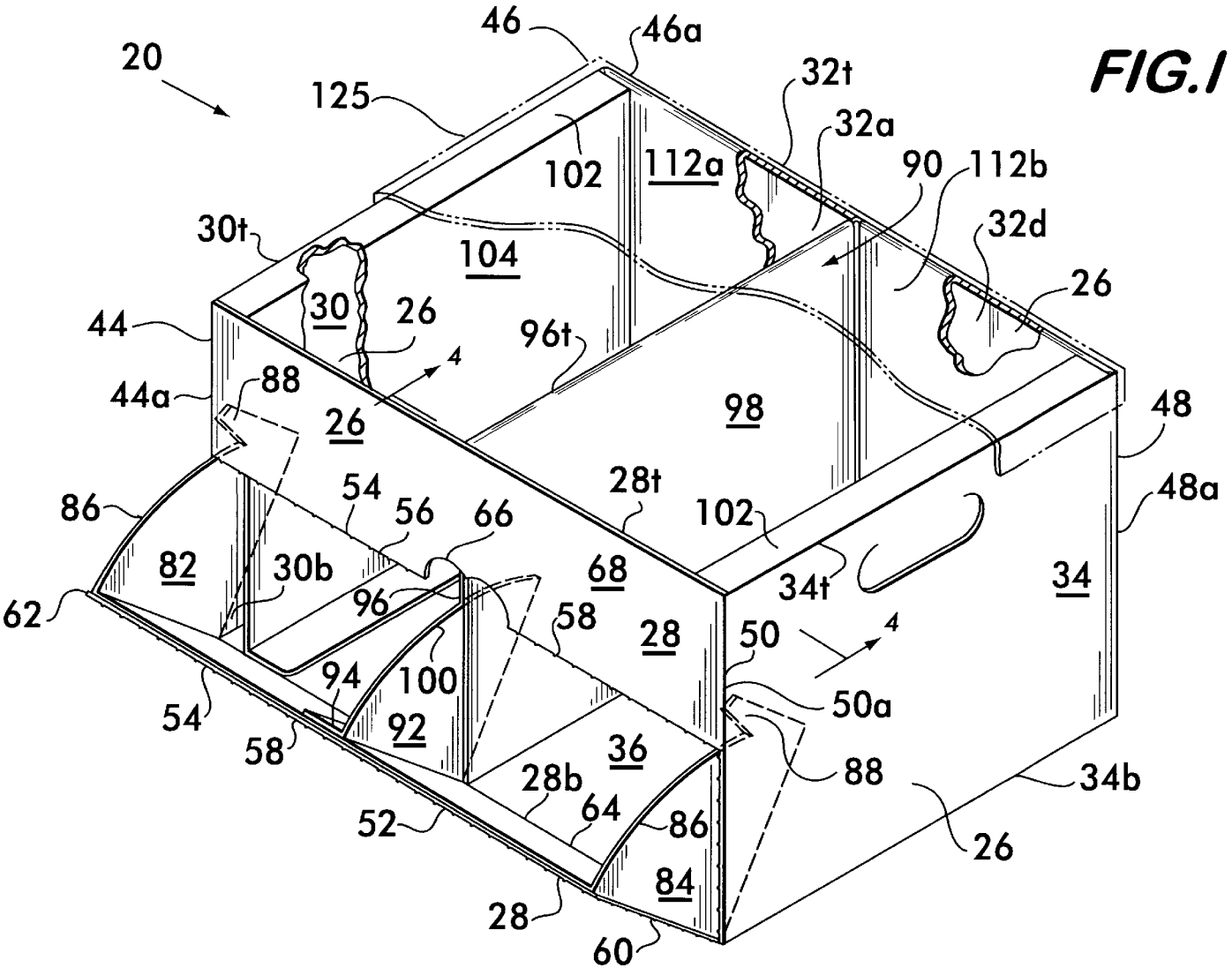
FIG. 1 shows a perspective view of an embodiment of a container having a pull-out panel according to the invention.
Figure 3:
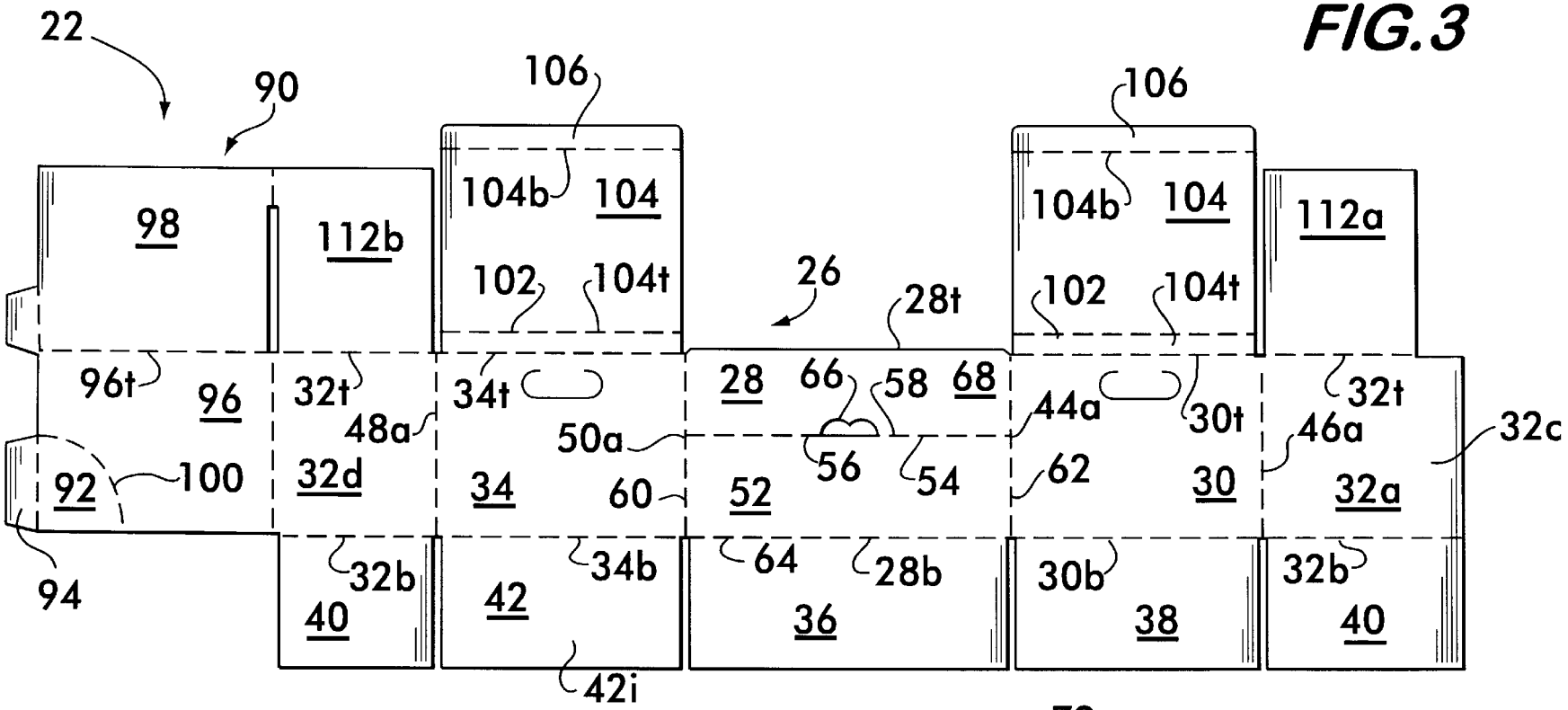
FIG. 3 shows a plan view of a blank used to form the container shown in FIG. 1.
Figure 3A:
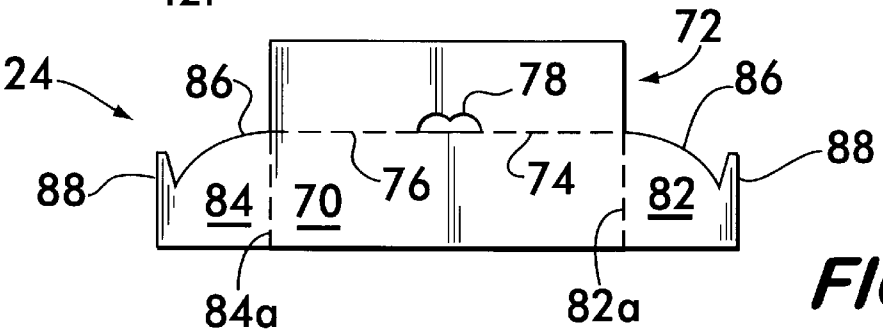
FIG. 3A shows a plan view of a blank which is combined with the blank shown in FIG. 3 to form the container shown in FIG. 1.

FIGS. 1, 3 and 3A show one embodiment of a container assembly 20 according to the invention. Container 20 is preferably fabricated from corrugated paperboard die cut to form the blanks 22 and 24 depicted in FIGS. 3 and 3A and folded as described below to form the container seen in FIG. 1.

Container 20 comprises multiple wall panels 26 attached to one another. Wall panels 26 include a first wall panel 28 having a top edge 28*t* and an oppositely disposed bottom edge defined by a fold line 28*b* a second wall panel 30 having oppositely disposed top and bottom edges defined by fold lines 30*t* and 30*b*a third wall panel 32 having top and bottom edges defined by fold lines 32*t* and 32*b* and a fourth panel 34 having top and bottom edges defined by fold lines 34*t* and 34*b*. The third wall panel 32 is formed of two partial panels 32*a*, 32*b* secured together as known in the art.

A bottom flap 36 is integrally and pivotally attached to the bottom edge 28*b* of the first wall panel 28. Preferably, second wall panel 30, third wall panel 32 and fourth wall panel 34 also are integrally and hingedly attached to respective bottom flaps 38, 40 and 42 along their respective bottom edges as illustrated. Blank 22 in FIG. 3 best illustrates the relationship of the wall panels 26 and the bottom flaps before they are folded to form container 20. The fold lines 28*b*, 30*b*, 32*b* and 34*b* define the separation between the wall panels and flaps and are formed by scoring the blank or other means as is well known in the art to form panels which are pivotally attached to each other.

First and second wall panels 28 and 30 are attached at a first corner 44 defined by a fold line 44*a*, second and third wall panels 30 and 32 are attached at a second corner 46 defined by a fold line 46*a*, third and fourth wall panels 32 and 34 are attached at a third corner 48 defined by a fold line 48*a*, and fourth and first wall panels 34 and 28 are attached at a fourth corner 50 defined by a fold line 50*a*. The fold lines are best seen in FIG. 3 and are preferably formed by scoring the blank.

Figure 5:
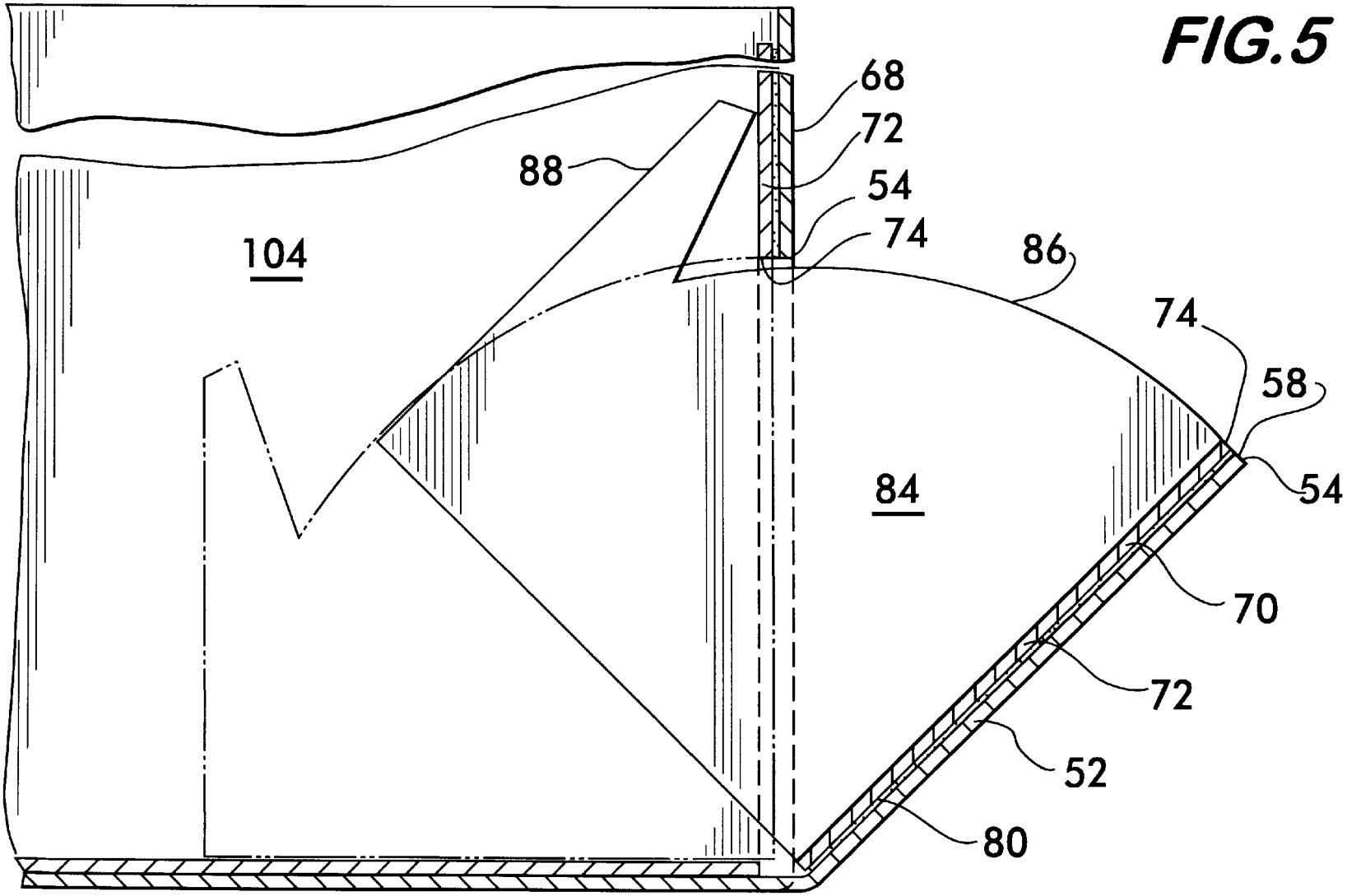
FIG. 5 is a partial cross-sectional view taken along the line 5—5 of FIG. 4.

As seen in FIG. 1 and in cross-section in FIG. 5, a pull-out panel 52 comprises a portion of the first wall panel 28. Pull-out panel 52 is defined by a separation line 54 which extends around the pull-out panel. Separation line 54 is preferably formed by a series of perforations 56 in the first wall panel which define a top edge 58 and side edges 60 and 62 of the pull-out panel. Pull-out panel 52 has a bottom edge 64 which is hingeably and integrally attached to the container. Preferably bottom edge 64 is coincident with the bottom edge 28*b* of first panel 28 and is hingeably and integrally attached to bottom flap 36 which extends from the first panel to form a bottom for the container as described below.

Pull-out panel 52 is movable from a closed position (seen in FIG. 2) to an open position shown in FIGS. 1 and 5, the open position providing access to display and dispense goods held within container 20. The pull-out panel 52 is manually separable from the first wall panel 28 by inserting one or more fingers into finger holes 66 provided adjacent to top edge 58 in the face of first wall panel 28 and drawing the pull-out panel 52 away from the container, the pull-out panel separating along the separation line 54 intentionally weakened by the perforations 56 defining the top and side edges (58, 60, 62) of the pull-out panel. When the pull-out panel 52 is moved to the open position, a top portion 68 of the first wall panel 28 remains attached to the container. The top portion is disposed above and is not part of the pull-out panel, as illustrated in FIGS. 1 and 5.

Figure 6:
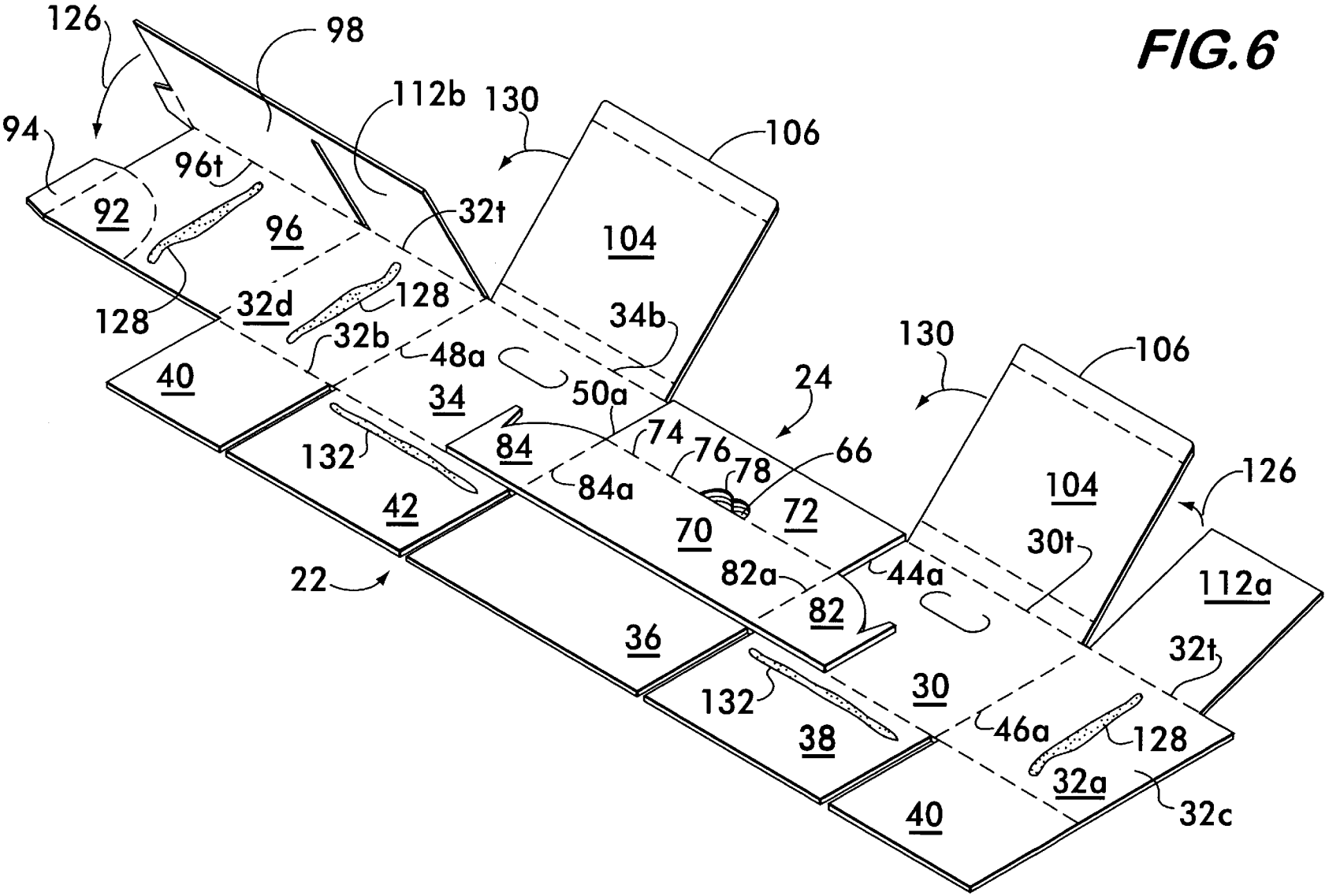
FIG. 6 is a perspective view illustrating steps in the formation of the container in the knockdown state of FIG. 2 from the blanks shown in FIGS. 3 and 3*a;*

As further seen in FIGS. 1 and 5, a sub panel 70 is secured to the inside face of the pull-out panel 52. While the sub panel could be confined to only overlie the pull-out panel 52, sub panel 70 is preferably formed as an integral part of a reinforcing panel 72, best illustrated as a die cut blank in FIG. 3A. The reinforcing panel 72 is attached to first wall panel 28 as seen in FIGS. 5 and 6. The sub panel has a separation edge 74 preferably defined by a series of perforations 76 in overlying registration with the top edge 58 of the pull-out panel 52. The reinforcing panel 72 will also have finger holes 78 in registration with finger holes 66 in the first wall panel 28. These features allow the sub panel 70 to be manually separated from the reinforcing panel 72 when the pull-out panel 52 is initially moved into the open position.

Sub panel 70 (and reinforcing panel 72, if present) is preferably secured to first wall panel 28 by means of adhesive 80, which could be, for example, a cold set or hot melt glue. Sub panel 70 reinforces the pull-out panel 52 and has a pair of wing flaps 82 and 84 which are integrally attached to the sub panel at respective fold lines 82*a* and 84*a*. The wing panels 82, 84 are spaced apart from one another at opposite sides of the sub panel 70. Wing flaps 82 and 84 extend inwardly of the container 20 and form side partitions which extend between the sub panel 70 and the container to prevent bulk goods from spilling out from the container when the pull-out panel is in the open position. The wing flaps 82, 84 have an upper profile 86 shaped to allow the wing flaps to pivot and pass beneath top portion 68 without contact. Although the preferred profile shape is arcuate, as illustrated in FIGS. 1 and 5, other shapes are also practicable. Preferably, the wing flaps have a hook section 88 positioned along and extending outwardly from the profile 86 to engage the top portion 68 and prevent further rotation of the pull-out panel 52 when in the open position.

Figure 4:
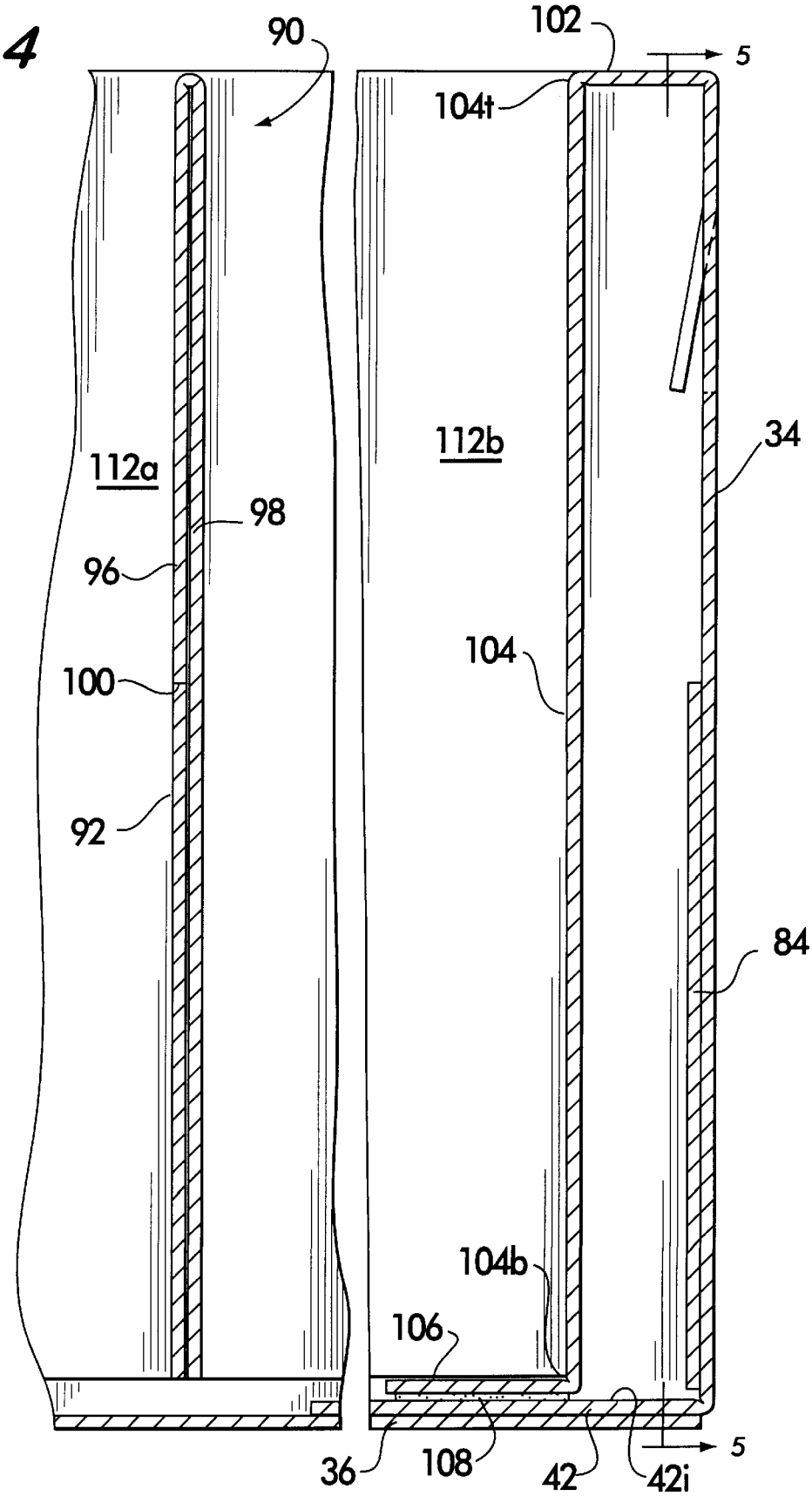
FIG. 4 is a partial cross-sectional view on an enlarged scale taken along the line 4—4 of FIG. 1.

Containers according to the invention may have a divider panel 90, illustrated in FIG. 1 and in cross-section in FIG. 4. Divider panel 90 extends between the first wall panel 28 and the oppositely arranged third wall panel 32 as best illustrated in FIG. 1. The divider panel provides a third wing flap 92 which is secured to the inside face of the sub panel 70 by means of a glue tab 94, the wing flap 92 extending inwardly of the container. The third wing flap 92 extends between divider panel 90 and sub panel 70 to form a partition continuous with the divider panel which keeps the bulk goods on either side of the divider panel separated when the pull-out panel 52 is moved into the open position. Preferably the divider panel 90 comprises a first divider panel 96 and a reinforcing panel 98 reverse folded about a fold line 96*t* so as to overlie the first divider panel in a face-to-face relationship (see FIGS. 3 and 4). The reinforcing panel 98 strengthens the divider panel and helps support the container to prevent crushing when other containers are stacked on top of it. The third wing flap 92 preferably comprises a portion of the first divider panel 96 as seen in FIG. 1, the wing flap being defined by a series of perforations 100 in the first divider panel 96. The perforations 100 are arranged in an arcuate profile which allows the third wing flap 92 to separate from the divider panel 96 and pass beneath the top portion 68 of the first wall panel when the pull-out panel 52 is moved to the open position. Although the third wing flap 92 is illustrated as comprising a portion of the first divider panel 96, it could alternatively comprise a portion of the reinforcing panel 98 as well.

Second wall panel 30 and fourth wall panel 34 preferably have shelf panels as disclosed in U.S. application Ser. No. 09/247,208 entitled "Automatic Shelf and Display Support for Containers", filed Feb. 2, 1999 and hereby incorporated by reference. Respective shelf panels 102, seen in FIGS. 3, 4, 4A and 4B, are integrally and pivotally attached to the top edges 30*t* and 34*t* of the second and fourth wall panels 30 and 34. The following description explains the operation using fourth wall panel 34 as an example, it being understood that the description is equally applicable to the shelf panel associated with second wall panel 30.

A reinforcing panel 104 acting as a link panel on the inside of the container 20 is adjacent to the fourth wall panel 34. A top edge of the link panel defined by a fold line 104*t* is attached integrally and pivotally to the shelf panel 102 spaced a distance S1 from the top edge 34*t* of the fourth wall panel 34 for reasons described below; a bottom edge 104*b* of the link panel 104 is defined by a fold line, the bottom edge being attached pivotally by glue tab 106 to the inside face 42*i* of the fourth wall panel bottom flap 42 and spaced a distance S2 from the bottom edge 34*b* of the fourth wall panel 34 as further described below. The glue tab 106 is secured with adhesive 108 (FIG. 4), as known in the art.

Figure 4A:
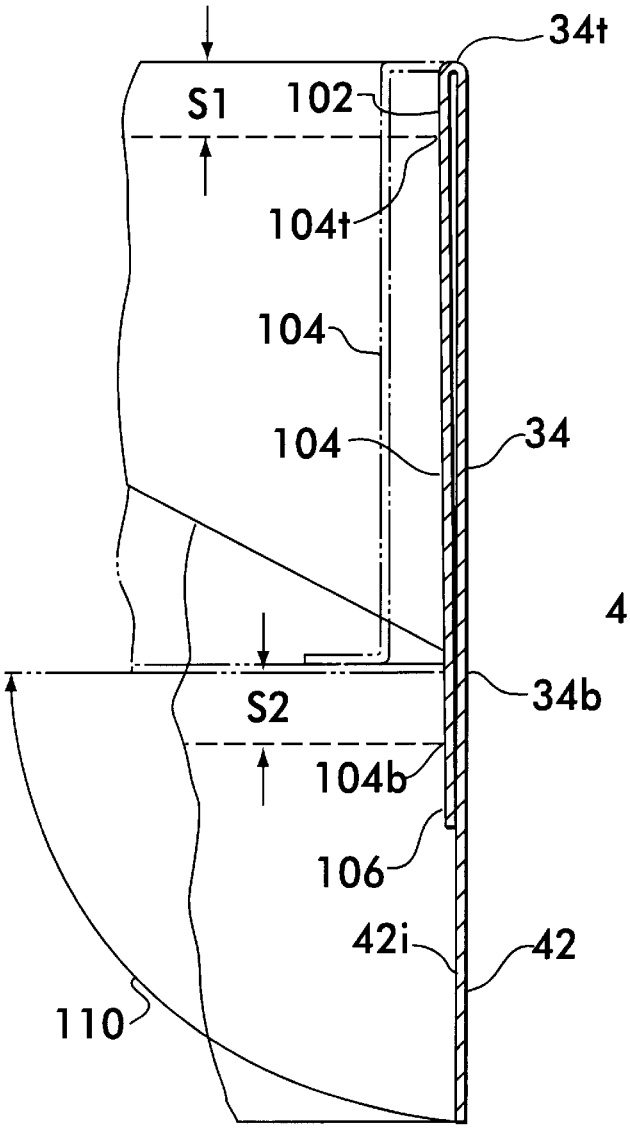
FIGS. 4A and 4B show details of the cross-sectional view seen in FIG. 4.
Figure 4B:
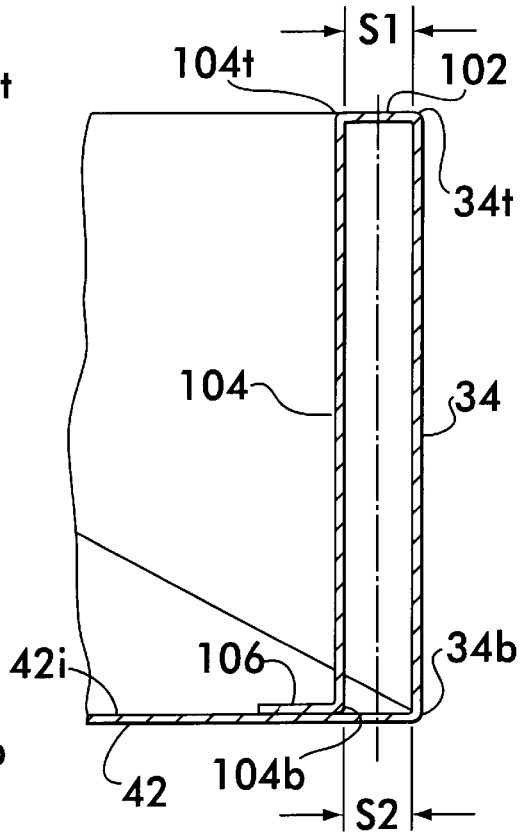

As illustrated in FIGS. 4A and 4B, folding bottom flap 42 during assembly of the container 20 automatically moves the shelf panel 102 into the horizontal position shown in FIGS. 1, 4 and 4B. The movement of the shelf panel 102 into the horizontal position is similar to that of a four bar linkage. Pivotal movement of the bottom flap 42 about the bottom edge fold line 104*b* (see arrow 110 of FIG. 4A) to form the container bottom causes the link panel 104 to move upwardly and away from the fourth wall panel 34, which in turn causes the shelf panel 102 to move from the vertical position shown in FIG. 4A to the horizontal position shown in FIG. 4B. The spacings S1 and S2 of the link panel 104 from the fourth side wall 34 are preferably similar (preferably between about 1 and 1½ inches) and the height of the link panel 104 and that of the fourth wall panel 34 are preferably similar so that the shelf panel 102 will remain parallel to the bottom flap 42 as it moves to the horizontal position.

The various fold lines (see FIG. 3) between the glue tab 106 and the link panel 104, between the link panel 104 and the shelf panel 102, between the bottom flap 43 and the fourth wall panel 34, and between the fourth wall panel 34 and shelf panel 102 ease the pivotal movement (folding) of these members. The fold lines may be formed as known in the art such as by score lines or a series of perforations.

As seen in FIGS. 1, 4, 4A and 4B, the present invention forms automatically a horizontal shelf structure 102 supported by the fourth wall panel 34 and the link panel 104 along opposite wall panels 30 and 34 of the container 20. This provides superior stacking strength as compared to a container having just a single layer wall panel forming the relevant wall panels.

Further strengthening of the container to enable it to resist crushing when stacked is provided by reinforcing flaps 112*a*, 112*b* which are respectively arranged in a face-to-face relationship with the third wall panel 32 as seen in FIG. 1. FIG. 3 shows reinforcing flaps 112*a*, 112*b* integrally and pivotally attached to adjacent partial panels 32*a*, 32*b* along the top edge defined by a fold line 32*t*. The fold line is formed typically by scoring the blank 22 and allows the reinforcing panel to pivot into the face-to-face relation with the third wall panel which it is reinforcing.

Figure 2:
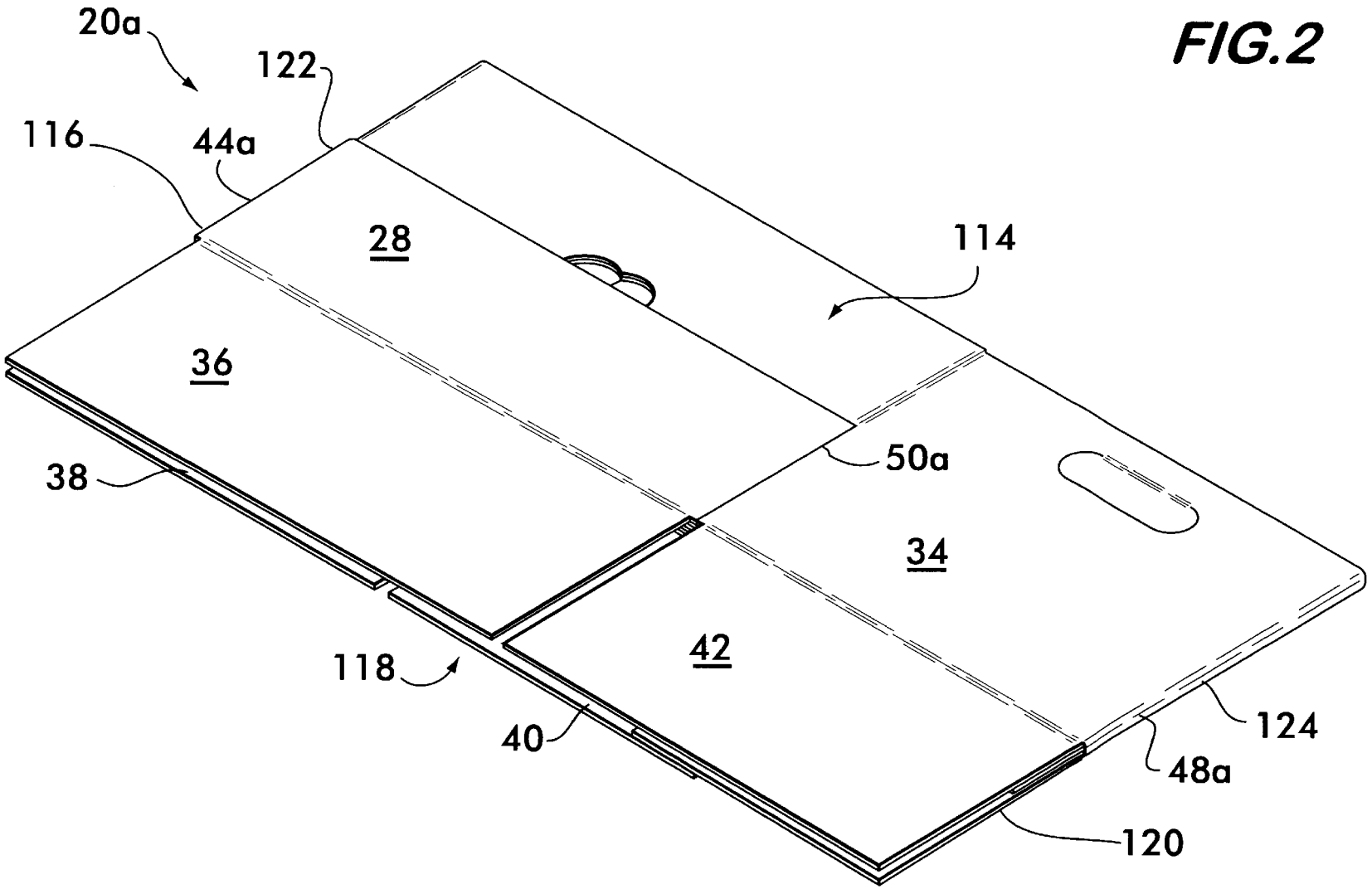
FIG. 2 shows a perspective view of the container shown in FIG. 1 in a knockdown state.

FIG. 2 illustrates the container 20 configured in the knockdown state 20*a*. This state is formed after the container is assembled from the die cut blanks which are shown in FIGS. 3 and 3A and described in detail below. The knockdown state allows the containers to be conveniently and efficiently shipped from the factory to the user who can then open the knockdown into the container shown in FIG. 1 using automated equipment. The container can then be filled, sealed and shipped to its destination.

The knockdown state 20*a* comprises a first knockdown wall 114 which includes first wall panel 28 and fourth wall panel 34 in a first plane 116 overlying a second knockdown wall 118 which includes second wall panel 30 and third wall panel 32 (both obscured in FIG. 2) in a second plane 120 substantially parallel to the first plane. Together the first and second knockdown walls form a substantially flat assembly which occupies a relatively small volume and can therefore be efficiently shipped in quantity to the user. First knockdown wall 114 is attached to the second knockdown wall 118 at a first knockdown corner 122 arranged between the first wall panel 28 and the second wall panel 30. (First corner 122 coincides with corner 44 and fold line 44*a* of container 20.) The first knockdown wall is further attached to the second knockdown wall at a second corner 124 arranged between the fourth wall panel 34 and the third side wall panel 32 (not shown in FIG. 2 but beneath wall panel 30). (Second corner 124 coincides with third corner 48 and fold line 48*a* of container 20.)

To form the container 20, seen in FIG. 1, from the knockdown state 20*a* shown in FIG. 2, the first and second knockdown walls 114 and 118 are moved apart from each other causing the two walls 114, 118 to fold and form the corners 46 and 50 and the basic shape as seen in FIG. 1. Once the first and third wall panels are fully separated the bottom flaps 36, 38, 40 and 42 are folded inward toward the container forming the bottom. Any type of suitable bottom may be used, including crash lock and RSC as examples. With the bottom formed, the container 20 is ready to be filled as seen in FIG. 1. Once filled, a top 125 is attached to fully enclose the container if desired. Top 125 is shown in broken line to suggest that almost any type of top known in the art can be used.

FIGS. 3, 3A, 6 and 7 illustrate a preferred way of constructing the container from the blanks 22 and 24 to form the knockdown state 20*a*. Blanks 22 and 24 seen in FIGS. 3 and 3*a* are die cut to form unitary blanks, preferably of corrugated paper board. The various fold lines which define the wall panels, divider panel, bottom flaps and reinforcing flaps and panels are formed during the manufacturing process, preferably by scoring the blank as is well known in the art.

FIG. 6 depicts a step following die cutting and scoring where sub panel 70, preferably as part of reinforcing panel 72, is attached on what will be the inside surface of first wall panel 28, adhesive being the preferred method of attachment. The sub panel is positioned to overlie pull-out panel 52. Separation edge 74 defined by perforations 76 is arranged in overlying registration with separation line 54 (hidden) on pull-out panel 52. Finger holes 78 in the reinforcing panel are also aligned with the finger holes 66 in the first wall panel 28. Fold lines 82*a* and 84*a* defining the wing panels 82 and 84 are aligned with the fold lines 50*a* and 44*a* respectively so that the wing flaps fold easily in conjunction with the second and fourth wall panels 30 and 34.

Next, reinforcing flaps 112*a*, 112*b* and reinforcing panel 98 are reverse folded about respective fold lines 32*t* and 96*t* as indicated by arrows 126 to be in face-to-face relationship with the respective panels 32*a*, 32*b* and 96 which they reinforce. Adhesive, as indicated at 128, can be used to secure the reinforcing flaps to the panels. Similarly, link panels 104 are reverse folded about fold lines 30*t* and 34*t* as indicated by arrows 130, bringing the link panels into face-to-face relationship with second and fourth wall panels 30 and 34 respectively and sandwiching wing flaps 82 and 84 between the link panels 104 and the second and fourth wall panels 30, 34 respectively. Glue tabs 106 on the link panels are secured to respective bottom flaps 38 and 42, preferably by means of adhesive 132.

Figure 7:
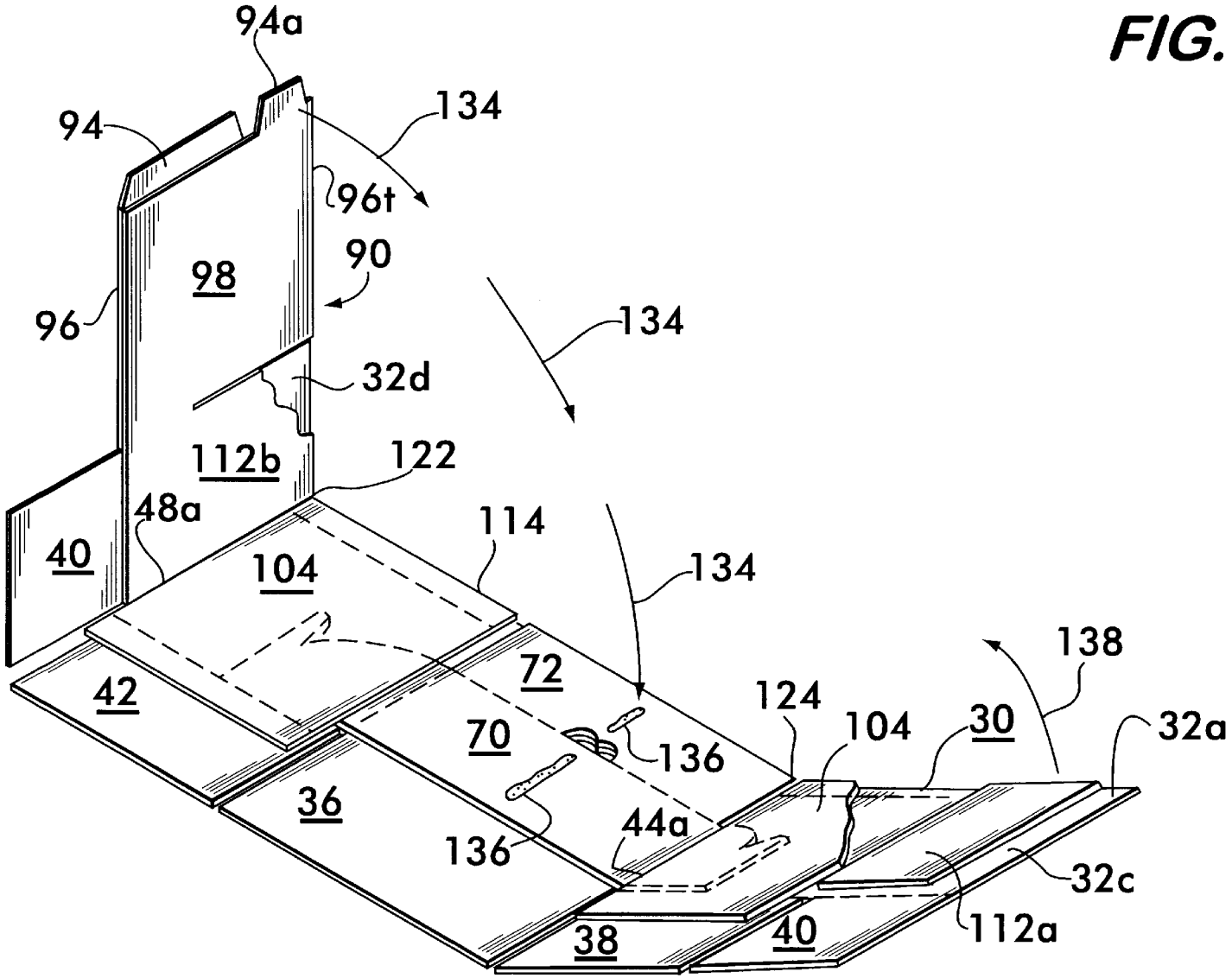
FIG. 7 is a perspective view illustrating further steps relative to FIG. 6 in the formation of the container in the knockdown state of FIG. 2 from the blanks shown in FIGS. 3 and 3*a;*

The series of steps described above will result in the intermediate configuration illustrated in FIG. 7 which is further manipulated to produce the knockdown configuration 20*a* of FIG. 2. Partial third wall panel 32*b* along with divider panel 90 and their respective attached reinforcing panels 112 and 98 are folded along fold line 48*a* as indicated by arrows 134 to form first knockdown corner 122. Glue tabs 94 and 94*a* extending from divider panel 90 are attached to reinforcing panel 72 (including sub panel 70) preferably by means of adhesive 136. Next, the other partial third wall panel 32*a* and second wall panel 30 along with their respective reinforcing flap 112 and link panel 104 are folded along fold line 44*a* as indicated by arrow 138 to form second knockdown corner 124. The two halves of third wall panel 32 are adhesively joined at glue tab 32*c* which extends from the partial panel 32*a*, thus forming the second knockdown wall 118 in overlying relationship with first knockdown wall 114 comprising the first and fourth wall panels 28, 34 and their associated reinforcing panels, as seen in FIG. 2.

FIGS. 8–16 depict a second embodiment of a container according to the invention having many similar features to the container embodiment described above. The reference characters in FIGS. 8–16 are the same as those for corresponding elements as shown in FIGS. 1–7, and the description referencing FIGS. 1–7 will not be repeated here for the elements which are the same or closely similar in the second embodiment, it being understood that reference can be made to the appropriate analogous figure for either embodiment when reading the description. However, additional description is provided below for those areas where the second embodiment departs from the first.

Figure 8:
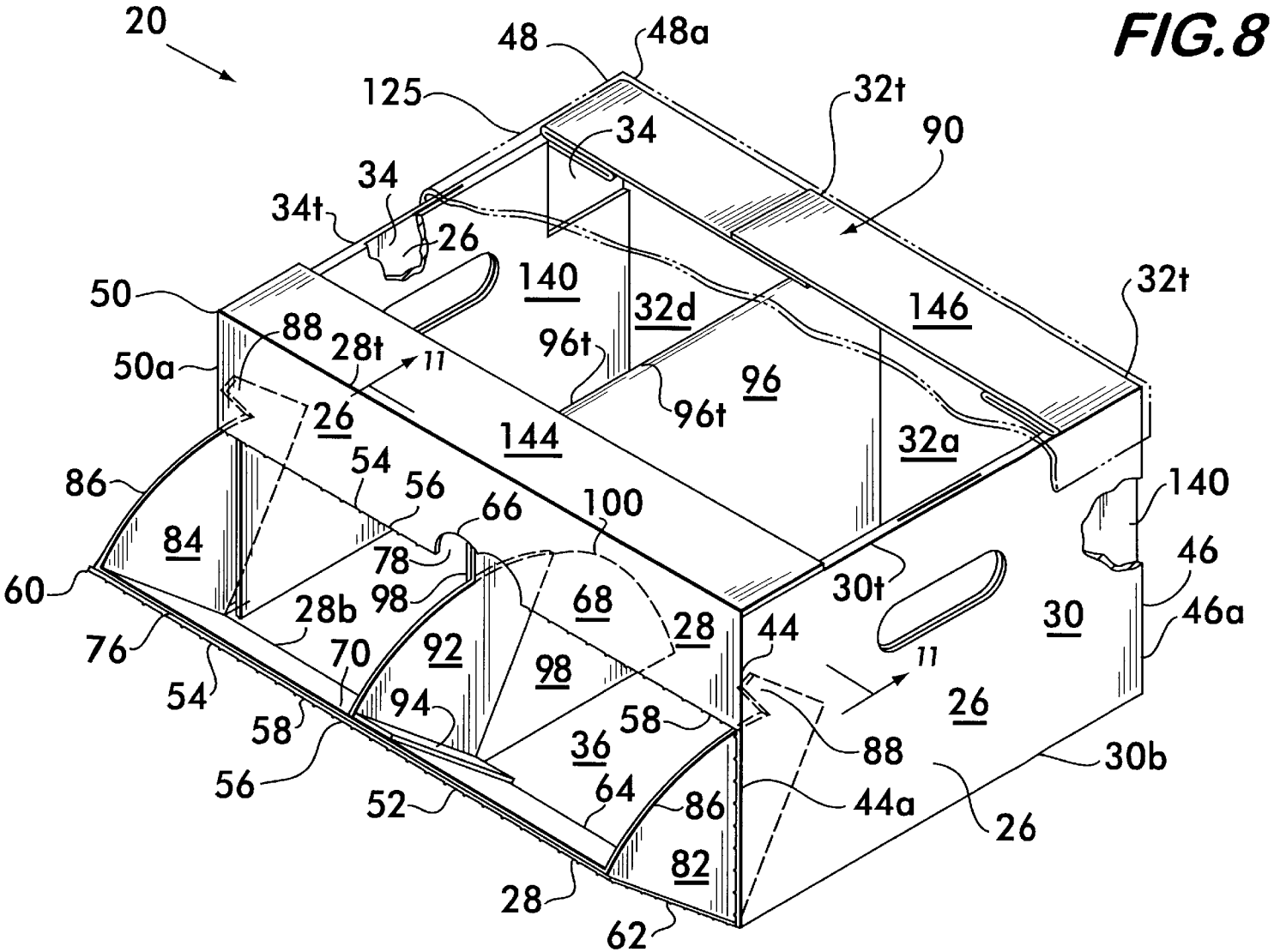
FIG. 8 is a perspective view of another embodiment of a container according to the invention.
Figure 9:
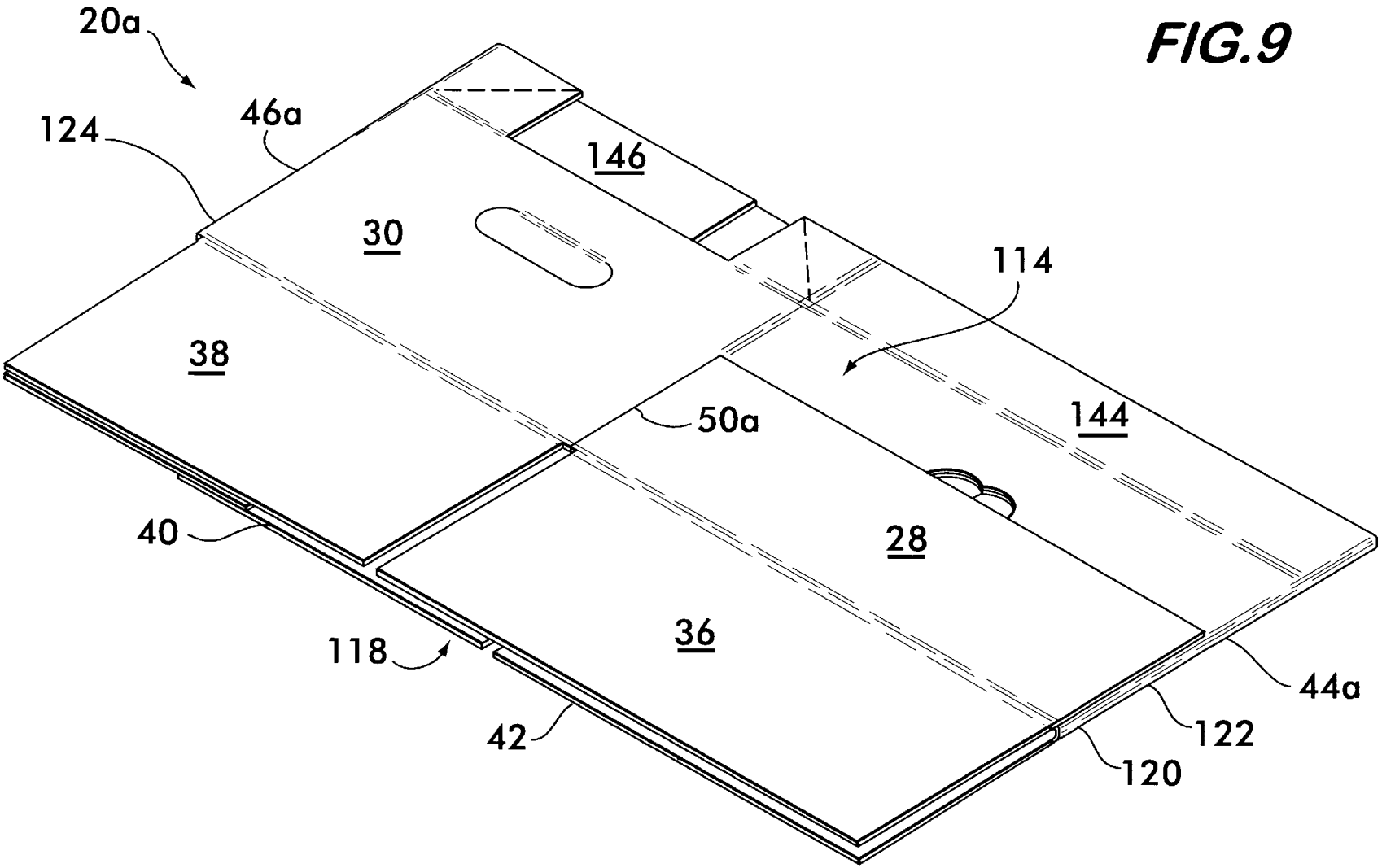
FIG. 9 is a perspective view of the container shown in FIG. 8 in the knockdown state.
Figure 10:
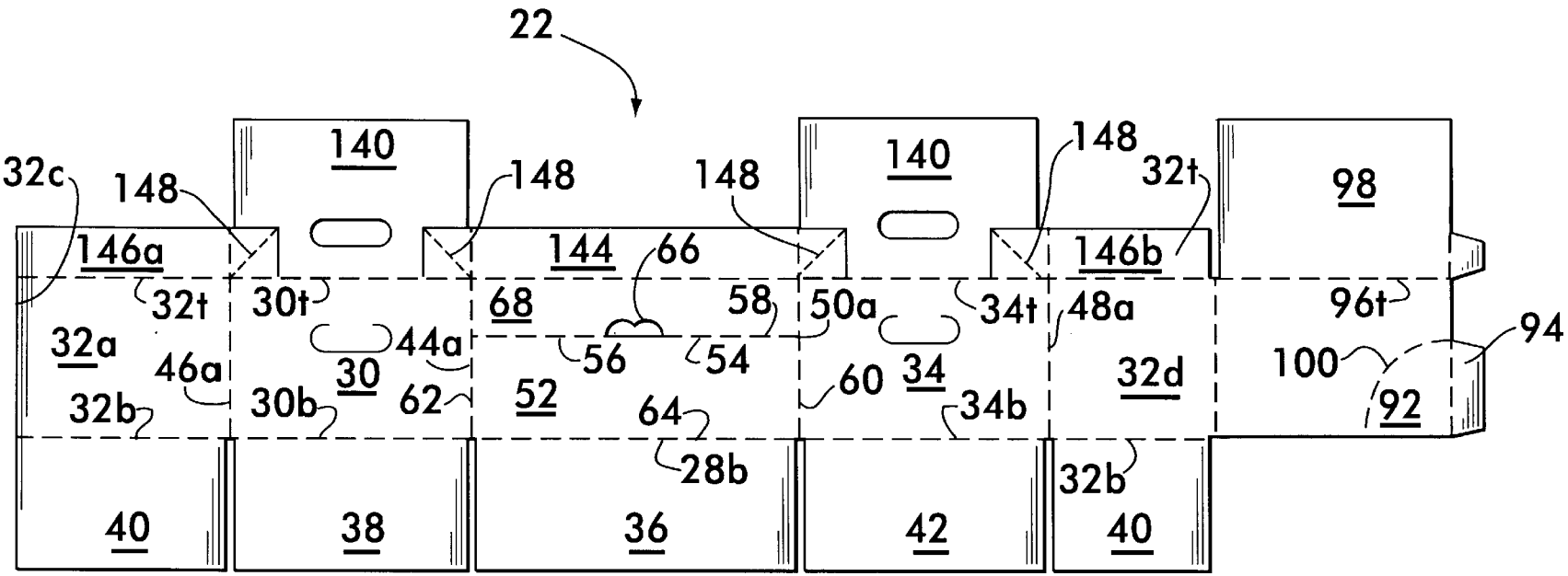
FIG. 10 is a plan view of a blank used to form the container shown in FIG. 8.
Figure 10A:
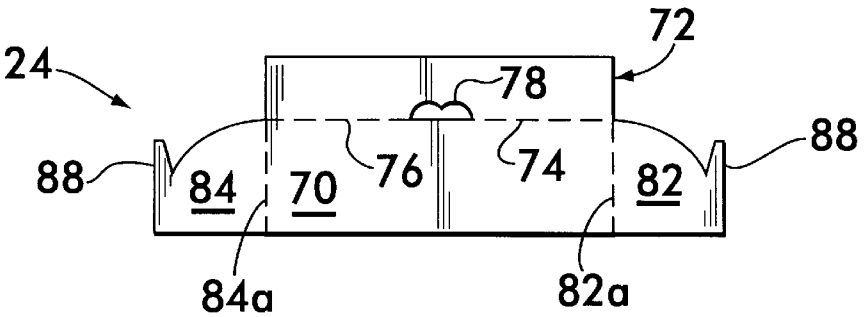
FIG. 10*a* shows a plan view of a blank which is combined with the blank shown in FIG. 10 to form the container shown in FIG. 8.
Figure 13:
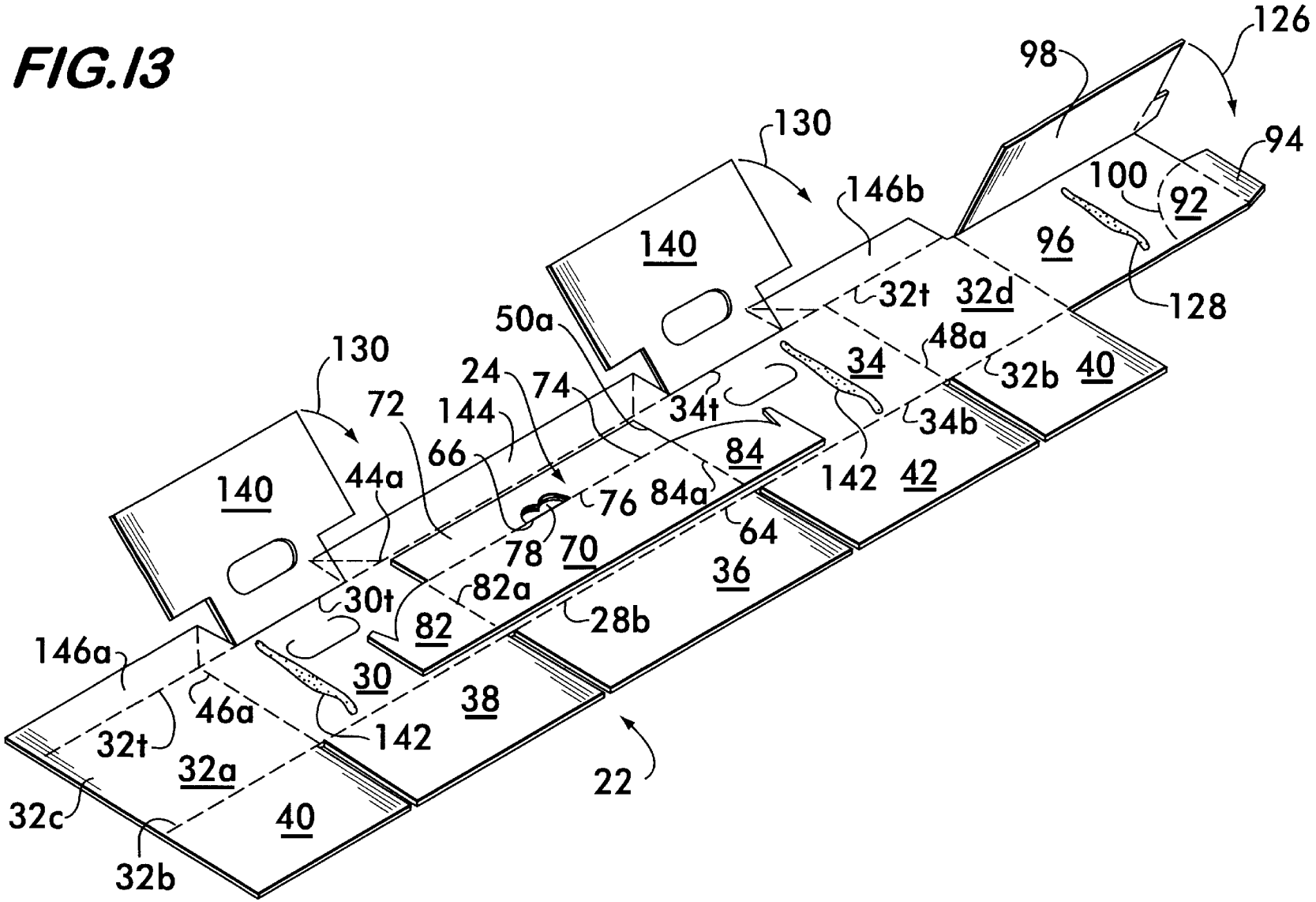
FIG. 13 is a perspective view illustrating steps in the formation of the container in the knockdown state of FIG. 9 from the blanks shown in FIGS. 10 and 10*a;*
Figure 14:
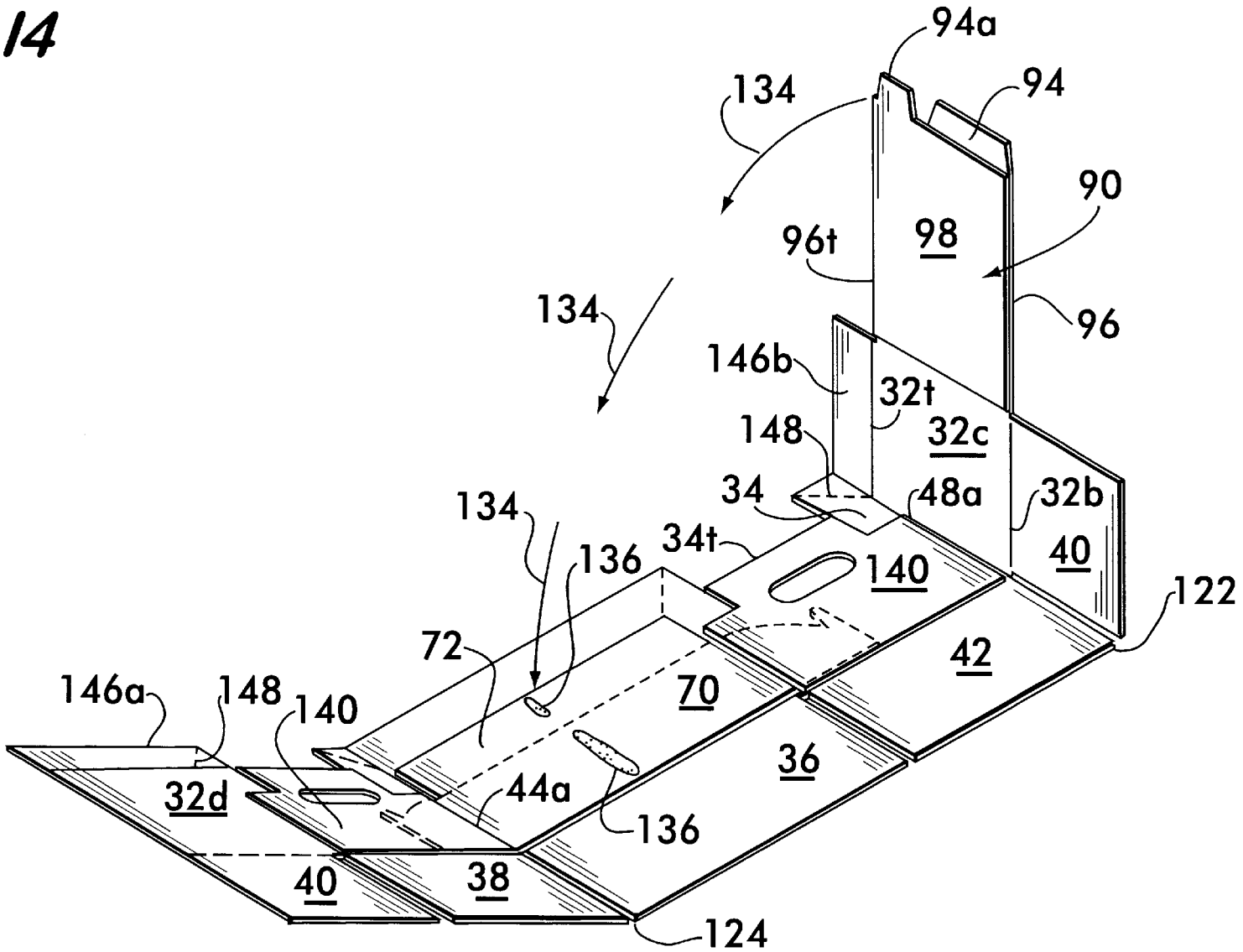
FIG. 14 is a perspective view illustrating further steps relative to FIG. 13 in the formation of the container in the knockdown state of FIG. 9 from the blanks shown in FIGS. 10 and 10*a;*

FIG. 8 illustrates the second embodiment of the container 20 where, for orientation purposes, the order of the wall panels 26 is renewed, e.g., in FIG. 10, wall panel 30 is to the left of the wall panel 28 and not the right, as shown in the embodiment of FIG. 3. Link panels 104 of the first embodiment are replaced by simple reinforcing panels 140 which are integrally attached to respective second and fourth wall panels 30 and 34 as seen in FIG. 10, the reinforcing panels being reverse folded as illustrated by arrows 130 (FIG. 13) about single fold lines 30*t* and 34*t* into a face-to-face relationship with the respective wall panels 30, 34. This folding is illustrated in FIG. 13 and is analogous to the folding of link panels 104 seen in FIG. 6 and described above. Wing flaps 82 and 84 of sub panel 70 are disposed between the reinforcing panels 140 and the respective second and fourth wall panels 30, 34 as a result of the folding. The reinforcing panels 140 can be secured to their respective wall panels by glue 142 if desired. Reinforcing panels 140 increase the container's resistance to bursting and crushing, especially when stacked with other containers. In the preferred embodiment, the reinforcing panels extend across the entire width of the respective wall panels.

The second difference involves strips 144 and 146 which overlie the top of the container above first and third wall panels 28 and 32 (32*a* and 32*b*). These strips provide a bridging element across the container from second wall panel 30 to reinforcing panel 90 and then to fourth wall panel 34 and provide support and reinforcement for stacking the containers.

Figure 11:
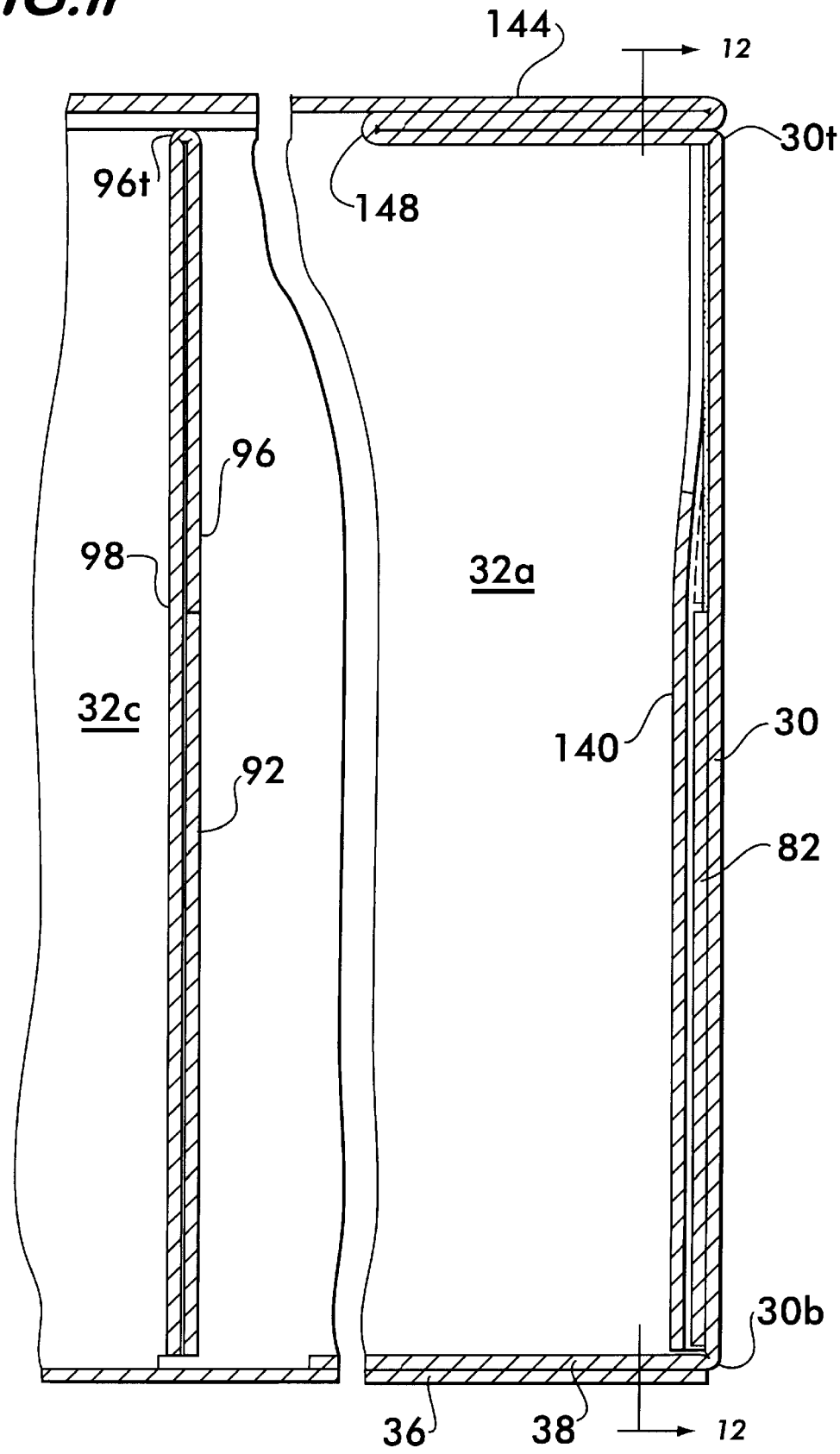
FIG. 11 is a partial cross-sectional view on an enlarged scale taken along line 11—11 of FIG. 8.
Figure 12:
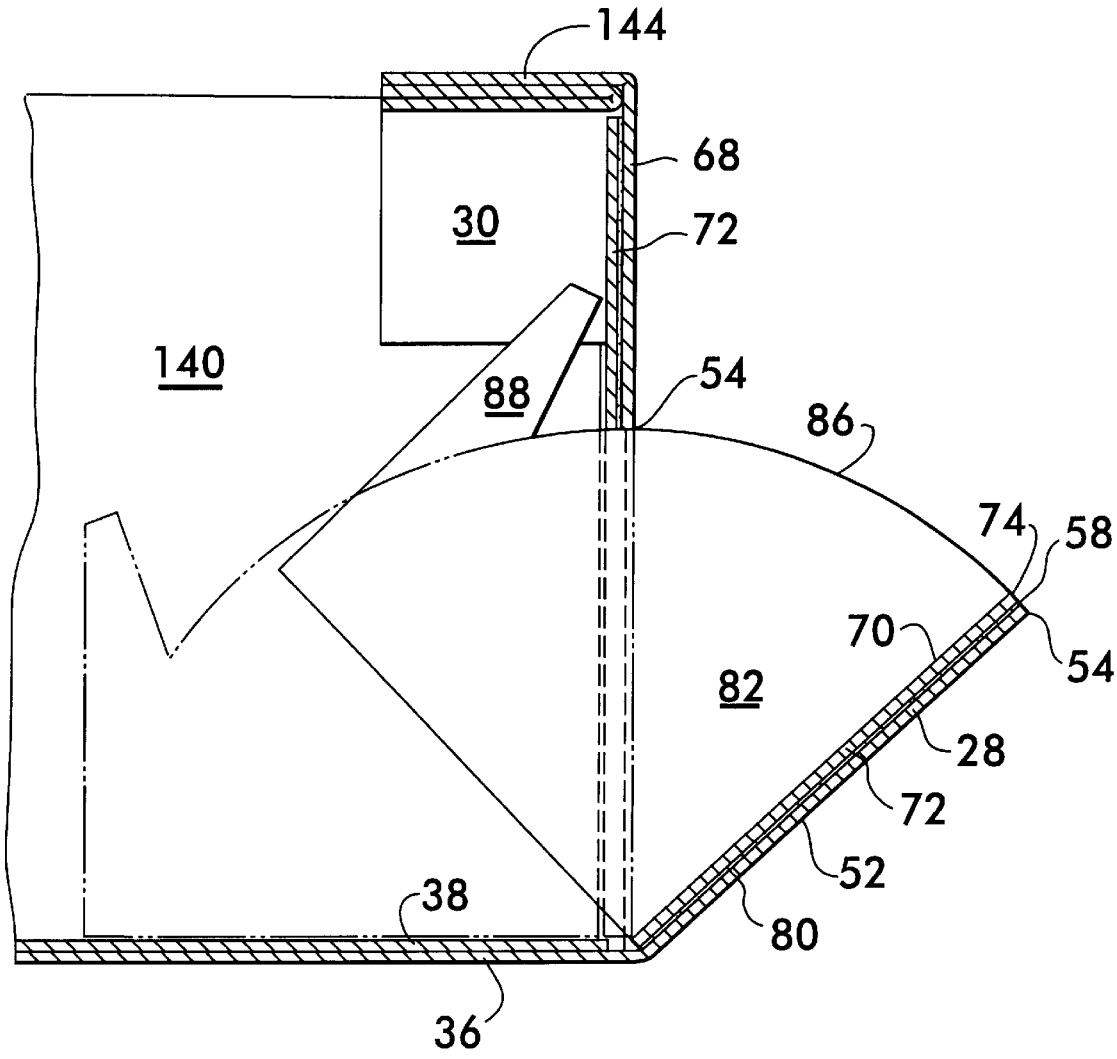
FIG. 12 is a partial cross-sectional view taken along line 12—12 of FIG. 11.
Figure 15:
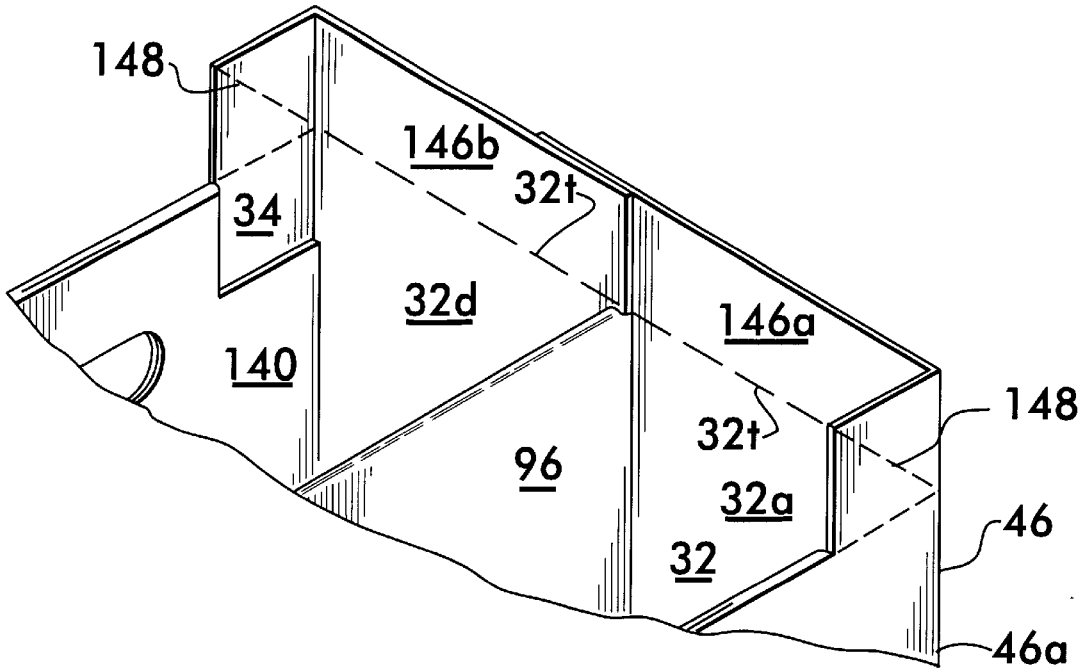
FIG. 15 shows a partial perspective view of a detail of the container of FIG. 8 in an unformed state.
Figure 16:
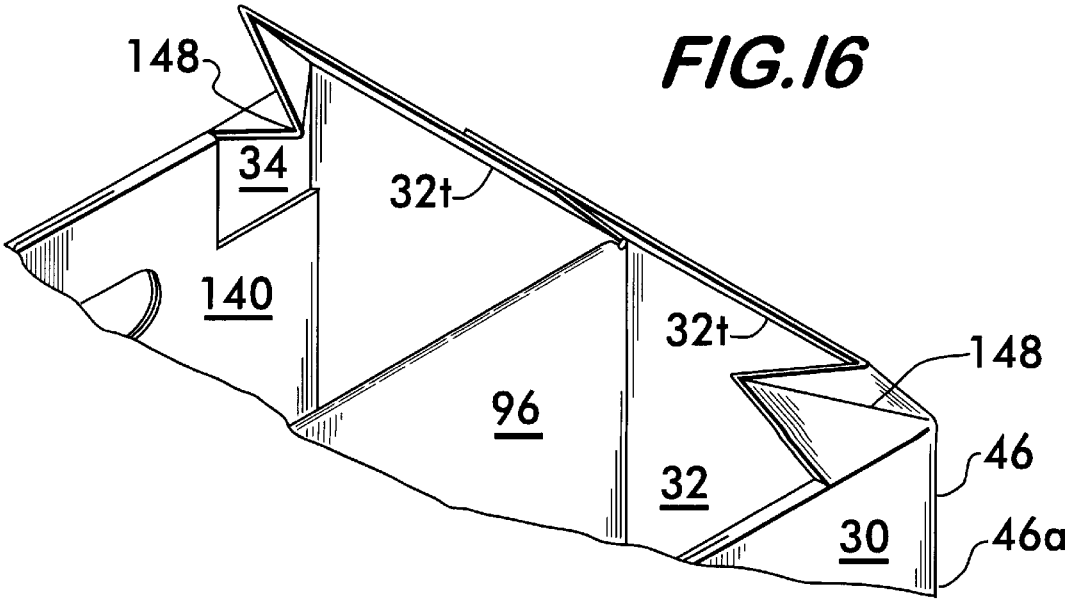
FIG. 16 shows a partial perspective view of the detail of the container of FIG. 8 during formation thereof.

As readily seen in FIGS. 10 and 15, strips 144 and 146 are integrally attached to wall panels 28 and 32 along fold lines 28*t* and 32*t* respectively. Strip 144 has portions 144*a* which extend beyond the first wall panel, each portion being integrally attached to the top edges of a neighboring wall panel over a relatively short distance. Similarly, strip 146 has portions 146*a* also attached to the top edges of the neighboring wall panels. Extending portions 144*a* and 146*a* result in the configuration shown in FIG. 15 when the container 20 is formed from the knockdown state 20*a* seen in FIG. 9. In order to allow the strips to fold along fold lines 28*t* and 32*t* and achieve the configuration seen in FIG. 8, each extending portion 144*a* and 146 a has a diagonally arranged fold line 148 which allows the extending portion to collapse inwardly as seen in FIG. 16 and permit the strips 144 and 146 to lie substantially flat across the top of the container. FIG. 11 shows a cross-sectional view through the extending portion 144*a* which shows how the portion lies like an accordion pleat when folded along diagonal fold line 148. Fold line 148 is preferably formed by a series of perforates in the extending portions along the fold line although other methods, such as scoring are also feasible. It is seen that the strips form a shelf-like structure that adds rigidity to the containers and helps support containers stacked on top.

A container according to the invention is made of a minimum of separate parts and is readily formable largely by automated machinery and is, therefore, inexpensive to manufacture. Since the container has a knockdown state, it can be conveniently shipped to a user who can assemble and fill it by automated processes, thus, reducing costs associated with packaging. The container is robust due to its extensive reinforcing flaps and panels and will therefore withstand the rigors of shipment and stacking. Once at its destination the container need not be unpacked but, due to its pull-out panel, the container can be manually opened to display and dispense its goods at the point of purchase.

While particular embodiments of the invention are described herein, it is not intended to limit the invention to such disclosures. Changes and modifications may be incorporated and embodied within the scope of the appended claims.

What is claimed is:

1. A container assembly comprising:

multiple wall panels attached to one another, each of said wall panels having oppositely disposed top and bottom edges, said multiple wall panels including a first, a second a third and a fourth wall panel, said second wall panel being attached to said first wall panel;

a bottom flap integrally attached to said bottom edge of said first wall panel;

a pull-out panel comprising a portion of said first wall panel and defined by a separation line, said pull-out panel having a bottom edge hingeably and integrally attached to said container, said pull-out section being moveable from a closed position to an open position;

a top portion defining a remainder of said first wall panel above and not part of said pull-out panel;

a sub panel overlying and secured to an inside face of said pull-out panel, said sub panel including a pair of wing flaps integrally attached thereto and space from one another, said wing flaps extending inwardly of said container;

a second wall reinforcing panel integrally connected to the top edge of said second wall panel and adjacent to said second wall panel in a face-to-face relationship, one of said wing flaps being disposed between said second wall panel and said second wall reinforcing panel; and said container having a knockdown state having first and second knockdown walls attached to one another at first and second knockdown corners to form a substantially flat assembly, wherein said first knockdown wall includes said first and fourth wall panels in a substantially same first plane and said second knockdown wall comprises said second and third wall panels in a second substantially same plane parallel to said first plane.

2. A container in accordance with claim 1, wherein said separation line comprises a series of perforations defining a top edge and two side ends of said pull-out panel.

3. A container in accordance with claim 2, wherein said bottom edge of said pull-out panel is defined by at least a portion of said bottom edge of said first wall panel.

4. A container in accordance with claim 3, wherein at least one of said pair of wing flaps includes a hook section positioned to engage said top portion when said pull-out panel is in the open position.

5. A container in accordance with claim 1, further comprising a divider panel extending between said first wall panel and one of said wall panels opposite said first wall panel, said pull-out panel further including a third wing flap secured thereto between said pair of wing flaps, said third wing flap extending inwardly of said container adjacent said divider panel.

6. A container according to claim 1, further comprising a strip integrally attached to one of said wall panels and extending along said top edge thereof, said strip being folded along said top edge through a right angle and extending inwardly of said container, said strip forming a substantially flat surface for supporting another container stacked on said strip, said strip having end portions integrally attached to respective wall panels arranged contiguous to said one panel, said end portions each folding along a respective pre-scored diagonal line in a direction inward of said container when said strip is folded and thereby providing support points for said strip at each end thereof.

7. A container in accordance with claim 1, wherein a face of said reinforcing panel is adhesively secured to a farce of said second wall panel.

8. A container in accordance with claim 1, wherein said fourth wall panel is attached to an opposite end of said first wall panel from said second wall panel, said container further comprising a fourth wall reinforcing panel integrally connected to the top edge of said fourth wall panel and adjacent to said fourth wall panel in a face-to-face relationship, the other of said wing flaps being disposed between said fourth wall panel and said fourth wall reinforcing panel.

9. A container in accordance with claim 1, wherein said reinforcing panel extends across the entire width of said second wall panel.

10. A container in accordance with claim 1, wherein said wing flaps are disposed at opposite ends of said sub panel and extend inwardly of said container perpendicularly from said sub panel.

11. A container in accordance with claim 1, further comprising a first wall reinforcing panel secured to and overlying an inner face of said first wall panel, said sub panel comprising a portion of said first wall reinforcing panel and separable therefrom along a series of perforations to permit said pull-out panel to move into the open position.

12. A container in accordance with claim 1, further comprising a second bottom flap integrally attached to the bottom edge of said second wall panel, wherein said reinforcing panel has a glue tab integrally connected to a bottom edge of said reinforcing panel, said glue tab being adhesively secured to said second bottom flap.

13. A container assembly comprising:

multiple wall panels attached to one another, each of said wall panels having oppositely disposed top and bottom edges, said multiple wall panels including a first, a second a third and a fourth wall panel;

a bottom flap integrally attached to said bottom edge of said first wall panel;

a pull-out panel comprising a portion of said first wall panel and defined by a separation line, said pull-out panel having a bottom edge hingeably and integrally attached to said container, said pull-out section being moveable from a closed position to an open position;

a top portion defining a remainder of said first wall panel above and not part of said pull-out panel;

a sub panel overlying and secured to an inside face of said pull-out panel, said sub panel including a pair of wing flaps integrally attached thereto and space from one another, said wing flaps extending inwardly of said container;

a divider panel extending between said first wall panel and one of said wall panels opposite said first wall panel, said pull-out panel further including a third wing flap secured thereto between said pair of wing flaps, said third wing flap extending inwardly of said container adjacent said divider panel; and said container having a knockdown state having first and second knockdown walls attached to one another at first and second knockdown corners to form a substantially flat assembly, wherein said first knockdown wall includes said first and fourth wall panels in a substantially same first plane and said second knockdown wall comprises said second and third wall panels in a second substantially same plane parallel to said first plane.

14. A container in accordance with claim 13, wherein said divider panel comprises a first divider panel and a reinforcing panel in face-to-face relationship with said first divider panel, a section of said third wing flap comprising a portion of said first divider panel and defined by a series of perforations in said first divider panel permitting said third wing flap to move away from said first divider panel when said pull-out panel is moved to the open position.

* * * * *

UNITED STATES PATENT AND TRADEMARK OFFICE

CERTIFICATE OF CORRECTION

PATENT NO. : 6,189,778 B1
DATED : February 20, 2001
INVENTOR(S) : Kanter

It is certified that error appears in the above-identified patent and that said Letters Patent is hereby corrected as shown below:

Column 4,
Line 22, change “32b” to -- 32d --

Column 6,
Line 61, change “32b” to -- 32d --

Column 7,
Line 67, change “32b” to -- 32d --

Column 8,
Lines 14 and 66, change “32b” to -- 32d --

Column 9,
Line 63, change “space” to -- spaced --

Column 11,
Line 22, change “space” to -- spaced --

Signed and Sealed this

First Day of April, 2003

JAMES E. ROGAN
*Director of the United States Patent and Trademark Office*